US007857920B1

(12) United States Patent
Mason

(10) Patent No.: US 7,857,920 B1
(45) Date of Patent: Dec. 28, 2010

(54) LOW TEMPERATURE CLEAN BURNING PYROTECHNIC GAS GENERATORS

(75) Inventor: Mark H. Mason, Inyokern, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 1261 days.

(21) Appl. No.: 11/217,850

(22) Filed: Aug. 22, 2005

(51) Int. Cl.
*C06B 45/10* (2006.01)

(52) U.S. Cl. ..... 149/19.4; 149/19.5; 149/92; 149/104; 149/105

(58) Field of Classification Search ..... 149/18, 149/19.4, 19.5, 92, 104, 105; 102/285
See application file for complete search history.

(56) References Cited

U.S. PATENT DOCUMENTS 3,247,035 A * 4/1966 Henderson ..... 149/19.7
6,238,499 B1 * 5/2001 Jones et al. ..... 149/19.4
6,291,711 B2 * 9/2001 Langlet ..... 564/59
6,395,859 B1 * 5/2002 Stern et al. ..... 528/44
6,576,072 B2 * 6/2003 Chan et al. ..... 149/19.2
6,613,168 B2 * 9/2003 Reed et al. ..... 149/19.5
6,632,378 B1 * 10/2003 Wallace et al. ..... 252/182.24
6,682,615 B2 * 1/2004 Chan et al. ..... 149/19.6
6,824,626 B2 * 11/2004 Charrette et al. ..... 149/19.91
6,905,561 B2 * 6/2005 Jones et al. ..... 149/19.4

* cited by examiner

*Primary Examiner*—Helene Klemanski
(74) *Attorney, Agent, or Firm*—Charlene Haley; Brian Drazich

(57) ABSTRACT

A propellant composition including, about 5 to about 30 weight % of a polymeric binder component having about 4 to about 10 weight % of at least one oxygen-rich pre-polymer, about 0.1 to about 2 weight % of at least one isocyanate curative, wherein the curative(s) react with alcohol groups on said pre-polymer(s) to formulate urethane linkages, about 1 to about 20 weight % of at least one plasticizer to improve processability and for oxygen balance of the composition, about 0.01 to about 1.0 weight % of at least one additive including cure catalyst(s) and stabilizer(s), about 1 to about 40 weight % of a mixture of high oxygen content insensitive gas generators in solid form, about 1 to about 50 weight % of at least one oxidizer, and wherein the composition is free of perchlorate.

14 Claims, 1 Drawing Sheet

LOW TEMPERATURE CLEAN BURNING PYROTECHNIC GAS GENERATORS

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The invention relates to low temperature clean burning pyrotechnic gas generators (propellants), and more specifically, a perchlorate free propellant with properties exhibiting low flame temperatures, low particulate concentrations in the exhaust gasses, and low burning rates capable of burning for in excess of 15 minutes.

BRIEF DESCRIPTION OF THE DRAWING

It is to be understood that the foregoing general description and the following detailed description are exemplary and explanatory only and are not to be viewed as being restrictive of the present invention, as claimed. Further advantages of this invention will be apparent after a review of the following detailed description of the disclosed embodiments, which are illustrated schematically in the accompanying drawing and in the appended claims.

DETAILED DESCRIPTION OF THE EMBODIMENTS

Figure 1:
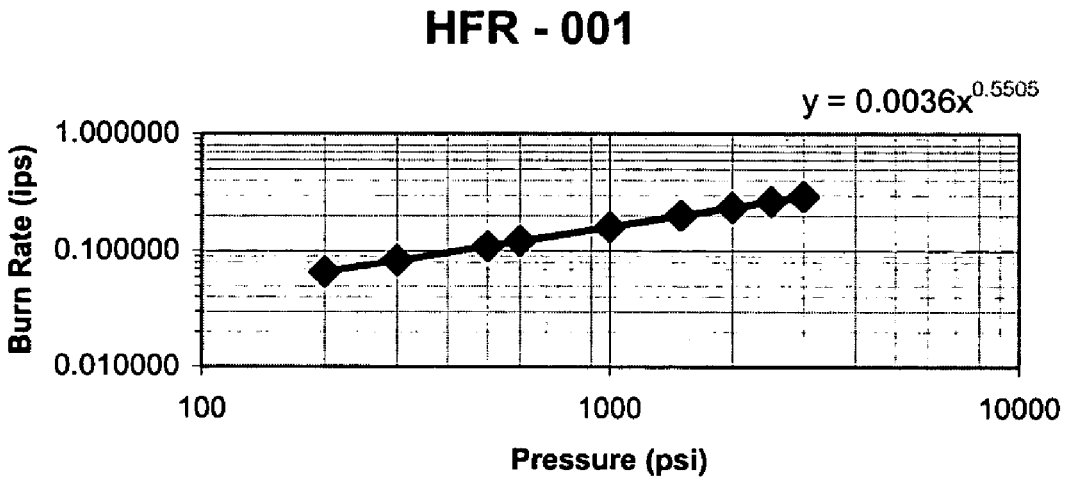
FIG. 1 is a graph illustrating the results of a strand experiment showing that the propellant demonstrated a burn rate of 0.16 in/s at 1000 psi at a pressure exponent of 0.55, according to embodiments of the invention.

The invention relates to low temperature clean burning pyrotechnic gas generators and/or propellant compositions. An aspect of the invention relates to a propellant composition including, about 5 to about 30 weight % of a polymeric binder component having about 4 to about 10 weight % of at least one oxygen-rich pre-polymer, about 0.1 to about 2 weight % of at least one isocyanate curative, wherein the curative(s) react with alcohol groups on said pre-polymer(s) to formulate urethane linkages, about 1 to about 20 weight % of at least one plasticizer to improve processability and for oxygen balance of the composition, about 0.01 to about 1.0 weight % of at least one additive including cure catalyst(s) and stabilizer(s), about 1 to about 40 weight % of a mixture of high oxygen content insensitive gas generators in solid form, about 1 to about 50 weight % of at least one oxidizer, and wherein the composition is free of perchlorate.

In embodiments of the invention, the plasticizer is a nitrate ester plasticizer. Another embodiment includes the plasticizer being a glycol ether derivative plasticizer. Other embodiments, the composition further includes up to about an additional 20 weight % of the plasticizer. Yet other embodiments of the invention include at least one nitrate ester plasticizer including 2,2'-bis(nitratomethyl)-2-methyl-1-nitratopropane (TMETN) and nitrate esters of poly (ethylene glycol) including triethylene glycol dinitrate (TEGDN), tetraethylene glycol dinitrate. Still yet in other embodiments, the plasticizer includes, but is not limited to, at least one of dimethyl or diethyl ethers of polyethylene glycol oligomers including dimethyl triethylene glycol and dimethyl tetraethylene glycol.

Embodiments of the invention include, but are not limited to, additives having about 0.01 to about 0.1 weight % of at least one catalyst. The cure catalysts utilized include, but are not limited to, at least one of triphenyl bismuth (TPB) acting with dinitrosalicyclic acids (DNSA), and triphenyl bismuth (TPB). In embodiments, the additives include about 0.4 of at least one stabilizer. The stabilizer utilized includes, but is not limited to, at least one of methylnitroaniline (MNA) and 2-nitrophenylamine (2-NDPA). The isocyanate curative utilized includes, but is not limited to, at least one of hexamethylene diisocyanate (HMDI), isophorone diisocyanate (IDPI), and HMDI condensation products including, but not limited, to Tolonate HDTLV-2, and Desmedour N-3200.

Embodiments of the invention utilizing oxygen-rich pre-polymer(s) includes, but is not limited to, at least one poly-functional hydroxy terminated copolymer of caprolactone with tetrahydrofuran (HTCE), poly functional hydroxy terminated polycaprolactones (PCP), poly-functional hydroxy terminated polyethylene glycols, poly-functional hydroxy terminated polypropylene glycols, poly-functional hydroxy terminated copolymers of ethylene glycol and polypropylene glycol, and poly-functional hydroxy terminated copolymers of ethylene oxide and polypropylene oxide.

In embodiments, the oxidizer utilized includes cyclotrimethylene-trinitramine (RDX). In other embodiments, the oxidizer includes, but is not limited to, at least one of octahydro-1,3,5,7-tetranitro-1,3,5,7-tetrazacyclocatane (HMX), hexanitrohexaazaisowurtzitane (CL-20), and 1,1'-diamino-2,2'dinitro ethane (aka FOX-7, DADE, 1,1'-diamino-2,2'dinitro ethylene). In embodiments, the gas generator(s) includes, but is not limited to, at least one of guanylurea dinitramide (FOX-12).

Another aspect of the invention relates to a composition including, about 10 to about 20 weight % of a polymeric binder component having, about 5 to about 10 weight % of at least one oxygen-rich pre-polymer including one poly-functional hydroxy terminated copolymer of caprolactone, and tetrahydrofuran (HTCE), about 1 to about 2 weight % of at least one isocyanate curative including Tolonate HDTLV-2, wherein the curative(s) react with alcohol groups on the pre-polymer(s) to formulate urethane linkages, about 4 to about 25 weight % of at least one plasticizer for oxygen balance of the composition including triethylene glycol dinitrate (TEGDN), and dimethyl tetraethylene glycol, about 0.02 to about 1 weight % of at least one additive, wherein the additive (s) including cure catalyst(s) including triphenyl bismuth (TPB) and dinitrosalicyclic acids (DNSA) and stabilizer(s) including methylnitroaniline (MNA), about 25 to about 45 weight % of a mixture of high oxygen content insensitive gas generators in solid form including guanylurea dinitramide (FOX-12), about 45 to about 55 weight % of at least one oxidizer including cyclotrimethylenetrinitramine (RDX), and wherein the composition is free of perchlorate. In this embodiment, the cyclotrimethylenetrinitramine (RDX) includes about 40 weight % of the composition. The guanylurea dinitramide (FOX-12) utilized in this embodiment includes about 29 weight % of the composition. The hydroxy terminated polycaprolactone (HTCE) utilized in this embodiment includes about 8.2 weight % of the composition. The plasticizer utilized in this embodiment includes about 20 weight % of the composition.

Certain applications require a pyrotechnic gas generator (or propellant) that burns with a relatively low flame temperature (less than 3000° F.), minimal particulate concentrations in the exhaust gasses, minimal oxidizing species in the combustion chamber and exhaust gasses, and burning rates flow enough for typical grain construct to burn for in excess of 15 minutes. (Ronald Milton, "Electromechanical Power Source." U.S. Pat. No. 4,638,173, Jan. 20, 1987. In these applications it is beneficial to exclude ammonium perchlorate (AP) gives hydrogen chloride (HCl) as an exhaust species, because HCl is corrosive gas the hardware construct will require the use of more exotic, and therefore, expensive materials to withstand this species for long periods of time at elevated temperatures. Furthermore, AP is known to give propellants that respond with unacceptable violence to thermal cook-off stimuli.

Embodiments of the invention relates to propellant compositions that eliminate the perchlorate from the formulation. Furthermore, these compositions offer the low flame temperature, and minimal particulate matter in the exhaust two properties that are important for low cost long duration applications. In order to minimize particulate concentration in the combustion products a propellant needs to burn as completely as possible. For clean exhaust, ideally the product gasses are only $CO_2$, $N_2$, and $H_2O$. However, achieving this balance is very difficult and requires an excess of oxidizer in the compositions. This gives an undesirable concentration of oxidizing species in the combustion chamber that generates an oxidizing environment (often at higher than optimal temperatures), which justifies the use of exotic and expensive materials to survive such hostile conditions.

EXPERIMENTAL RESULTS AND PROPHETIC EXAMPLES

Embodiments of the invention include a polyurethane binder formulated to be very oxygen rich, reducing the need for excess solid oxidizer. The polymeric constituent of the binder is comprised of an oxygen rich pre-polymer. The isocyanate curative chosen are to give the correct balance of pot life and physical properties in the fully cured propellant formulations. Hexamethylene diisocyanate (HMDI), or condensation products of HMDI like Desmedour N-3200 or Tolonate HDTLV-2 are good choices for balancing of pot life and physical properties of the propellant formulations. The use of specific plasticizers are very important since they have a profound affect on burning rate, temperature, safety properties, and exhaust signature. In these experiments, a mixture of triethylene glycol dinitrate (TEGDN) and tetraethylene glycol dimethyl ether was used. The TEDGN was chosen to improve performance (as measured by Isp) and provide an oxygen rich plasticizer. The tetraethylene glycol dimethyl ether was for its relatively high oxygen balance, high boiling point, and the ability to moderate the flame temperature.

HTCE is an inexpensive, mildly oxygenated polymer, and has been demonstrated in past insensitive munitions programs to have good potential in propellants. Plasticizers including TEGDN are utilized for oxygen content, this is the least sensitive, and one of the least expensive nitrate ester plasticizers. Furthermore, tetraethylene glycol dimethyl ether is a high oxygen content, low energy plasticizer, it improves the oxygen balance and cools the flame. N-3200 and HMDI are isocyanate curatives found to work well with HTCE in past programs. MNA is utilized as a stabilizer for the TEGDN. Both triphenyl bismuth and dinitrosalicylic acid are mild cure catalysts, and have the least propensity for causing cook off problems. The RDX is a solid oxidizer, it helps improve over all mechanical properties and fine crystals on the order of about 1 to about 15 micrometers are relatively insensitive to low intensity shock stimuli. Guanylurea dinitramide (FOX-12) is a solid gas generator that is predicted to improve the sensitivity characteristics of the propellant with minimal impact on oxygen balance and performance. However, its energy density and oxygen balance are too low to be used alone, therefore an oxidizer is also used in some embodiments.

In these formulations, the solids include a mixture of high oxygen content gas generating species including guanylurea dinitramide (aka GUDN, and FOX-12), cyclotrimethylenetrinitramine (RDX), and or 1,1'-diamino-2,2'dinitro ethane (aka DADE, FOX-7). The ratio of each gas generator is determined by the application of the propellant compositions. FOX-12 is utilized for low flame temperature and low shock sensitivity. RDX is utilized to give high performance at low cost. And FOX-7 is utilized as a less shock sensitive alternative to RDX.

An example propellant (HFR-05) was formulated using an HTCE binder system with guanylurea dinitramide gas generator and RDX as the oxidizer is given in Table 1.

TABLE 1

HFR-05 Formulation

| Ingredient | Mass Percent |
|---|---|
| HTCE (CAPA 720) | 7.92 |
| TEGDN | 13.50 |
| Tetraethylene Glycol Dimethyl Ether | 6.60 |
| N-3200 | 1.08 |
| HMDI | 0.50 |
| MNA | 0.4 |
| Triphenyl Bismuth & Dinitrosalicylic Acid | Trace each |
| Class 5 RDX | 40 |
| Guanylurea Dinitramide (FOX-12) | 30 |

The above formulation has been studied in window bomb cinematography and strand burning tests. In the strand burner experiment the pressure was varied from 200-3000 psi. The formulation demonstrated a burning rate of 0.16 in/s at 1000 psi, with a pressure exponent of 0.55 as shown in FIG. 1. The test results are below summarized in Table 2.

TABLE 2

Burning rates calculated from strand burner data Table 1.

| P (psi) | BR (ips) |
|---|---|
| 200 | 0.065846 |
| 300 | 0.082314 |
| 500 | 0.109050 |
| 600 | 0.120560 |
| 1000 | 0.159710 |
| 1500 | 0.199660 |
| 2000 | 0.233920 |
| 2500 | 0.264500 |
| 3000 | 0.292420 |

The test results of the formulation above suggest that the small scale safety properties are very good as shown in Table 3. The impact sensitivity is over 100 cm (neat RDX standard=19 cm), and neither the friction nor electrostatic discharge sensitivity testing equipment could measure a "fire" meaning this formulation is exceptionally insensitive. Furthermore, the vacuum thermal stability (VTS) test result of 0.46 g/cc shows very good thermal compatibility of this formulation.

TABLE 3

Safety Properties of the formulation in Table 1.

| Impact | Friction | ESD | VTS |
|---|---|---|---|
| 50% Pt = 117 cm Low Fire Pt = 100 cm | 10/10 No Fires @ 1000 LBS | 10/10 No Fires @ 0.25 J | 0.46 cc/g |

The theoretical performance, as calculated by PEP-2100, shows very low particulate concentrations for a propellant with an Isp of over 200s and a combustion temperature under 2500° F. This is summarized in Table 4.

TABLE 4

Comparison of Theoretical Performance of Gas Generators.

| | | 480 psi → 14.7 psi | |
|---|---|---|---|
| Propellant | Chamber Temp. ° F. (480 psi) | Particulates, expressed as [Carbon] | Isp (s) |
| HFR-05 | 2267 | 2.89 | 209.0 |

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A propellant composition, comprising:

about 5 weight % to about 30 weight % of a polymeric binder component containing about 4 weight % to about 10 weight % of poly-functional hydroxy terminated copolymer of caprolactone and tetrahydrofuran;

about 0.1 weight % to about 2 weight % of at least one isocyanate curative reactive with alcohol groups on said poly-functional hydroxy terminated copolymer of caprolactone and tetrahydrofuran to form urethane linkages;

about 1 weight % to about 21 weight % of triethylene glycol dinitrate plasticizer;

about 0.01 weight % to about 1.0 weight % of at least one additive containing cure catalyst and stabilizer;

about 1 weight % to about 40 weight % of at least one solid gas generators; and about 1 weight % to about 50 weight % of at least one oxidizer having a particle size of about 1 to about 15 micrometers and said composition is free of perchlorate.

2. The composition according to claim 1, further comprising up to about an additional 20 weight % of said plasticizer.

3. The composition according to claim 1, wherein said additive comprises about 0.1 weight % to about 0.0 I weight % of at least one cure catalyst.

4. The composition according to claim 1, wherein said cure catalyst comprises a mixture of triphenyl bismuth (TPB) and dinitrosalicyclic acids (DNSA).

5. The composition according to claim 1, wherein said additive comprises about 0.4 weight % of at least one stabilizer.

6. The composition according to claim 1, wherein said stabilizer comprises methylnitroaniline (MNA).

7. The composition according to claim 1, wherein said oxidizer is cyclotrimethylenetrinitramine (RDX).

8. The composition according to claim 1, wherein said gas generator comprises guanylurea dinitramide.

9. The composition according to claim 1, wherein said isocyanate curative comprises aliphatic polyisocyanate based on hexamethylene diisocyanate trimer.

10. A composition, comprising:

about 10 weight % to about 20 weight % of a polymeric binder component including about 5 weight % to about 10 weight % of poly-functional hydroxy terminated copolymer of caprolactone and tetrahydrofuran;

about 1 weight % to about 2 weight % of isocyanate curative reactive with alcohol groups on said poly-functional hydroxy terminated copolymer of caprolactone and tetrahydrofuran to form urethane linkages;

about 4 weight % to about 25 weight % of triethylene glycol dinitrate plasticizer;

about 0.02 weight % to about 1 weight % of additive containing cure catalyst triphenyl bismuth (TPB) and stabilizer methylnitroaniline (MNA);

about 25 weight % to about 45 weight % of guanylurea dinitramide; and about 45 weight % to about 55 weight % of oxidizer cyclotrimethylenetrinitramine (RDX) having a particle size of about 1 to about 15 micrometers.

11. The composition according to claim 10, wherein said cyclotrimethylenetrinitramine (RDX) comprises about 40 weight % of said composition.

12. The composition according to claim 10, wherein said guanylurea dinitramide comprises about 29 weight % of said composition.

13. The composition according to claim 10, wherein said poly-functional hydroxy terminated copolymer of caprolactone and tetrahydrofuran comprises about 7.8 weight % to about 8.2 weight % of said composition.

14. The composition according to claim 10, wherein said plasticizer comprises about 20 weight % to about 21 weight % of said composition.

* * * * *